US007673917B2

(12) United States Patent
Oliason

(10) Patent No.: US 7,673,917 B2
(45) Date of Patent: Mar. 9, 2010

(54) VARIABLE DIAMETER LIFTING TONGS

(76) Inventor: Marc Oliason, P.O. Box 846, Santa Barbara, CA (US) 93102

( * ) Notice: Subject to any disclaimer, the term of this patent is extended or adjusted under 35 U.S.C. 154(b) by 264 days.

(21) Appl. No.: 11/891,199

(22) Filed: Aug. 8, 2007

(65) Prior Publication Data

US 2008/0036229 A1 Feb. 14, 2008

Related U.S. Application Data

(60) Provisional application No. 60/837,700, filed on Aug. 14, 2006.

(51) Int. Cl.
*B66C 1/42* (2006.01)

(52) U.S. Cl. ..... 294/110.1; 294/118

(58) Field of Classification Search ..... 294/110.1, 294/100.2, 112, 118, 106, 110.2
See application file for complete search history.

(56) References Cited

U.S. PATENT DOCUMENTS

| | | | | | |
|---|---|---|---|---|---|
| 113,799 | A * | 4/1871 | Rugg | 294/62 |
| 1,457,104 | A | 5/1923 | Connor et al. | |
| 2,286,071 | A * | 6/1942 | Dragan et al. | 294/119 |
| 3,011,821 | A | 12/1961 | Doty | |
| 3,029,100 | A | 4/1962 | Laine | |
| 3,697,118 | A * | 10/1972 | Johnstone et al. | 294/110.1 |
| 4,527,823 | A * | 7/1985 | Straus | 294/16 |
| 4,743,056 | A | 5/1988 | Oliason | |
| 5,409,280 | A | 4/1995 | Hill | |
| 5,842,729 | A | 12/1998 | Bunn | |
| 6,568,731 | B2 * | 5/2003 | Alexander et al. | 294/110.1 |
| 7,165,795 | B2 * | 1/2007 | Williams | 294/16 |
| 2006/0202497 | A1 * | 9/2006 | Cveykus | 294/118 |

* cited by examiner

*Primary Examiner*—Dean J Kramer
(74) *Attorney, Agent, or Firm*—James M. Duncan, Esq.; Klein, DeNatale, Goldner, etc.

(57) ABSTRACT

Pipe lifting tongs are utilized for lifting cylindrical sections of pipe, where the pipe sections may have different diameters but the jaw assemblies of the lifting tongs do not need to be changed out. The lifting tongs comprise first and second jaw members, where each jaw member may match the other. The jaw members comprise interiorally facing arcuate gripping members. The jaw members are pivotally connected together with a central fastener. Each jaw member comprises a mounting member rigidly joined to its respective gripping member. The mounting member may comprise a pair of parallel plate members, where a spaced defined between the parallel plate members. Each plate member comprises a plurality of apertures, including both circular and slotted apertures. When the first and second opposing jaw members are pivotally connected together, the parallel plate members may be sandwiched together, such that many of the apertures in the parallel plate members are aligned. The lifting tongs may be adjusted to fit different pipe diameters by changing the apertures which are utilized.

12 Claims, 5 Drawing Sheets

VARIABLE DIAMETER LIFTING TONGS

CROSS-REFERENCE TO RELATED APPLICATION

U.S. Provisional Application No. 60/837,700 for this invention was filed on Aug. 14, 2006 for which the inventor claims domestic priority.

BACKGROUND OF THE INVENTION

The present invention generally relates to lifting tongs for use in lifting heavy sections of cylindrical pipe, and more particularly to tongs which may be adjusted so that a variety of different diameters may be lifted with the tongs.

In laying pipelines for use as water lines, sewer lines, oil and gas lines and for other purposes the pipelines are assembled from sections of hollow, tubular, cylindrical lengths of pipe. Each section of pipe may weigh as much as several thousand pounds. Consequently, the sections typically can be lifted only with a heavy duty crane. The lifting cable of the crane must be provided with some means for gripping the cylindrical sections of pipe. While pipe sections may be lifted by means of encircling loops of cable which encompass individual pipe sections, more typically the pipe sections are lifted and laid in place using some form of tongs.

Certain limitations exist in the types of pipe tongs which are generally available. Specifically, conventional pipe tongs are manufactured with jaws having gripping members which are particularly suitable for use in cradling pipe sections having outer diameters falling within a rather limited range. Different pipe tongs are required to lift pipe sections of different diameters. For example, commercially available pipe tongs which are designed to lift pipe four inches in outside diameter cannot lift pipe having an outer diameter of fifteen inches. Moreover, conventional pipe tongs are dangerous to use for lifting pipe of a diameter which may vary only slightly from the optimum diameter for which the tongs are designed. When pipe tongs are utilized to lift pipe sections having a diameter greater than the diameter for which the tongs are designed, the tongs are likely to grip the circumference of the pipe over an insufficient arc. Consequently, the pipe can fall from the tongs, thus creating a serious risk of injury and damage. On the other hand, when pipe tongs are utilized to lift pipe of a diameter smaller than the diameter for which they are designed, the pipe is grasped too loosely, and can slide lengthwise relative to the tongs. When this occurs, the pipe can drop and likewise create a very serious risk of injury or damage.

A further limitation of conventional pipe tongs is that the gripping force with which the tong jaws grasp the wall of the pipe may be insufficient to adequately grip extremely heavy pipe, even though that pipe is of a diameter which the tongs are designed to lift. A heavy pipe section can thereby slip from the grasp of the jaws and drop.

The inventor herein is the owner of U.S. Pat. No. 4,743,056, which discloses lifting tongs comprising first and second opposing jaws and first and second mounting plates which are rigidly joined to the first and second jaws. Other types of pipe tongs employed for this purpose are manufactured by Crescent Tongs, Inc., located at 1840 Coronado Ave., Long Beach, Calif. 90804 and sold under the trade designation Crescent Pipe Tongs. The lifting tongs disclosed in U.S. Pat. No. 4,743,056 require changing out interchangeable jaws in order to pick up pipe sections having substantially different diameters.

SUMMARY OF THE INVENTION

The invention of the present application comprises lifting tongs or pipe tongs designed to lift cylindrical sections of pipe having different diameters without the need to change out jaw assemblies. For example, by changing the positions of no more than two bolts or pins, an embodiment of the disclosed lifting tongs may be adjusted such that the tongs are suitable for lifting substantially different pipe diameters. For example, by changing the positions of the two fasteners in an embodiment of the disclosed device, the same lifting tongs may be used for both 6-inch diameter pipe and 8-inch diameter pipe.

The lifting tongs comprise first and second opposing jaw members, where each jaw member may match the other. The jaw members comprise interiorally facing arcuate gripping members. The jaw members are pivotally connected together with a central fastener. Each jaw member comprises a mounting member rigidly joined to the arcuate gripping member. The mounting member may comprise a pair of parallel plate members, the parallel plate members defining a space there between, where each plate member comprises a plurality of apertures. When the first and second opposing jaw members are pivotally connected together, the parallel plate members may be sandwiched together, such that many of the apertures in the parallel plate members are aligned.

The parallel plate members of each jaw member may comprise at least three fixed or circular apertures and two slotted apertures. When sandwiched together, the circular apertures of the first jaw member may be are aligned with slotted apertures of the second jaw member and vice-versa. In this embodiment, fasteners may be inserted into the apertures such that the range of pivoting of the first jaw member with respect to the second jaw member is controlled by the length of the slotted apertures. The operating range of the lifting tongs is controlled by the particular fixed apertures which are utilized.

The lifting tongs further comprise a lifting linkage assembly. The lifting linkage assembly comprises linking arms connected at an apex formed by the respective first ends of each linking arm. A first lobe and a second lobe are each attached at the second end of each linking arm. Each lobe has at least two apertures in addition to the aperture used for attaching the lobe to the linking arms. Each lobe is disposed within the space defined between the parallel plates, such that the apertures of each lobe align with apertures of the parallel plates.

The lifting linkage assembly works cooperatively with the opposing jaws such that as a lifting force is applied to the apex of the lifting linkage, each lobe is also lifted, thereby causing each jaw member to pivot toward the opposing jaw member, causing the jaws to close about the pipe. Movement of the lifting linkage assembly, and the resulting actuation of the jaw members, results in a high degree of mechanical advantage relative to the amount of movement of the actuating mechanisms.

The range of closure is controlled by the limited travel of the fasteners within the slotted apertures. When it is desired to change to lifting tongs to a different size of pipe, such, for example from a large diameter pipe to a smaller diameter pipe, the fasteners are switched to from the large diameter fixed apertures to the smaller diameter fixed apertures.

DESCRIPTION OF THE EMBODIMENTS

Figure 1:
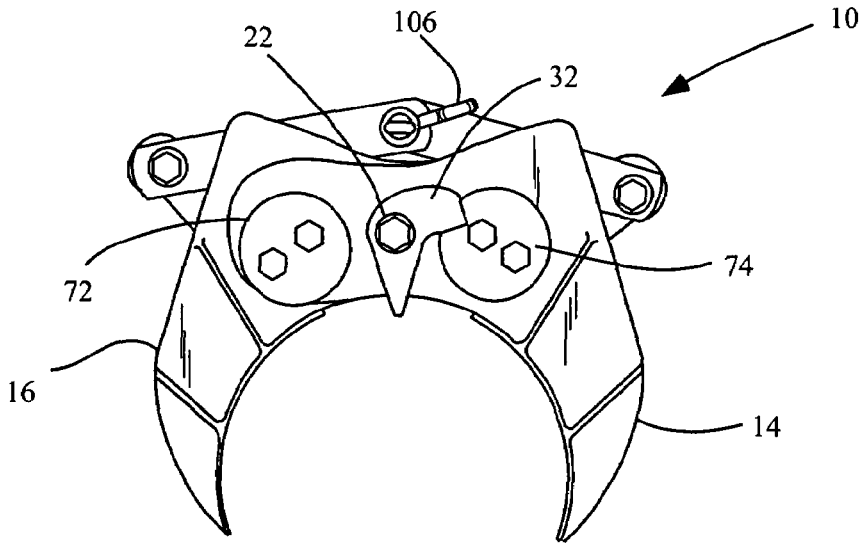
FIG. 1 shows a front view of an embodiment of the disclosed lifting tongs, prior to engaging a length of pipe.
Figure 2:
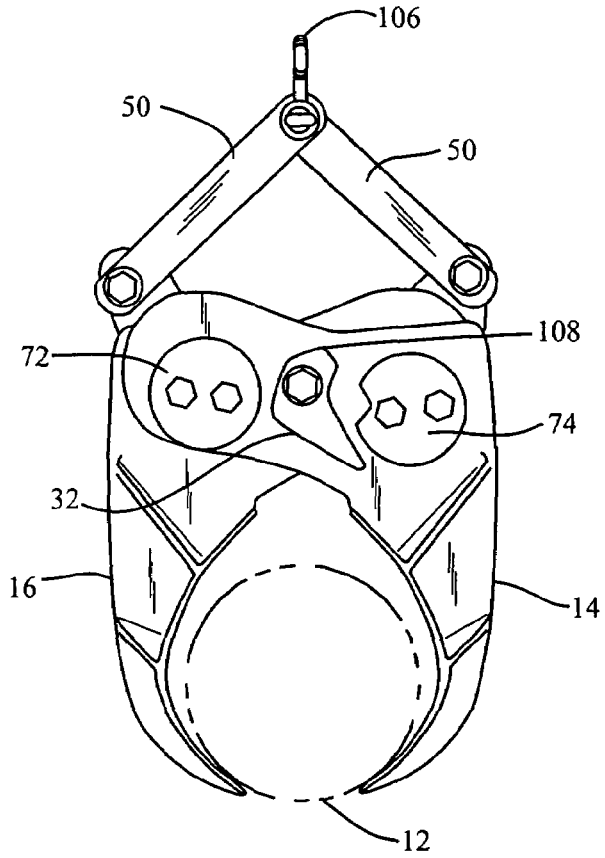
FIG. 2 shows a front view of an embodiment of the disclosed lifting tongs when an upward force is applied to the lifting linkage, causing the opposing jaws to close around a piece of pipe.
Figure 3:
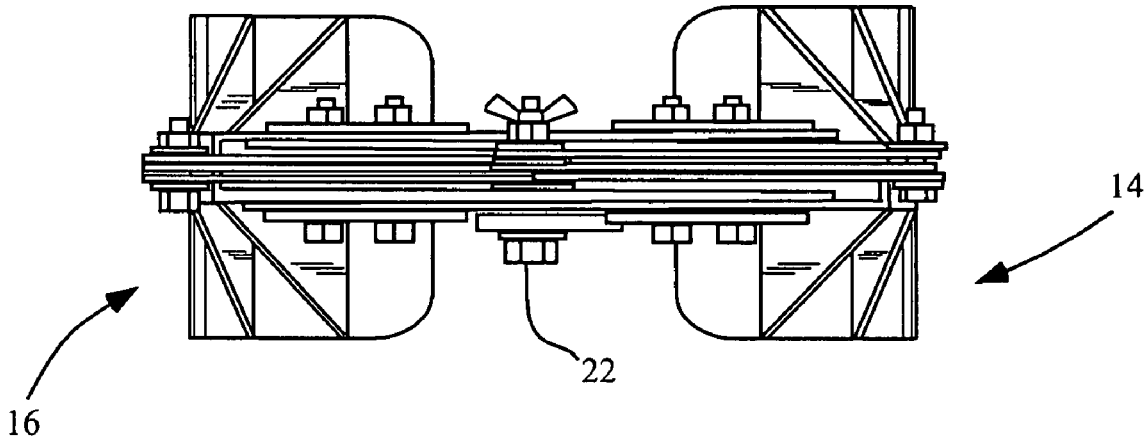
FIG. 3 is a top view of an embodiment of the disclosed lifting tongs.
Figure 4:
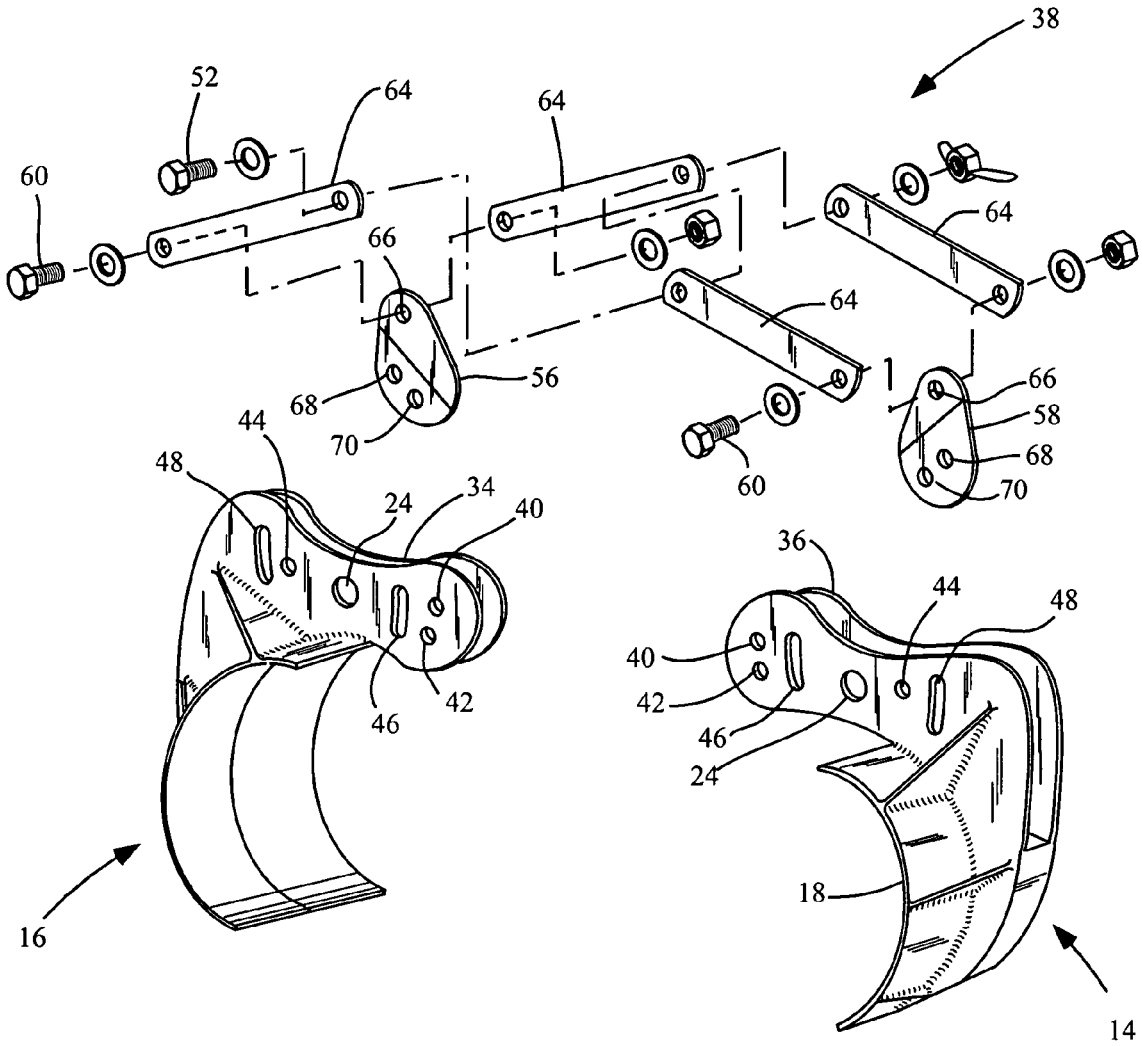
FIG. 4 shows an exploded view of lifting linkage and the respective jaw members which may be used in an embodiment of the disclosed lifting tongs (not shown are the fasteners utilized in the jaw members which are shown in FIG. 5).
Figure 7:
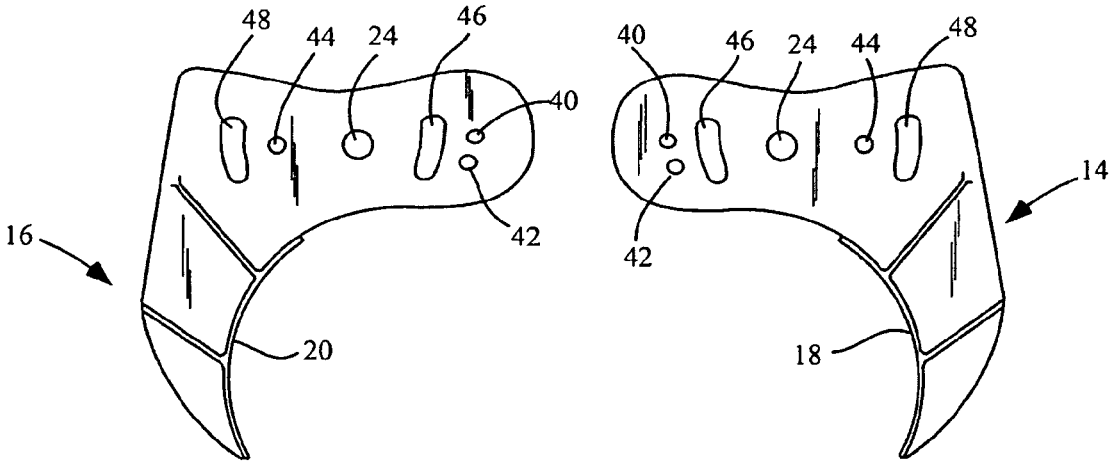
FIG. 7 shows the jaw members separated, showing a configuration of fixed and slotted apertures which may be used in an embodiment of the disclosed lifting tongs.

FIGS. 1 and 2 show an embodiment of the disclosed lifting tongs 10, which may be utilized for lifting cylindrical sections of pipe 12. The lifting tongs 10 comprise first jaw member 14 and an opposite facing second jaw member 16. The jaw members 14,16 may be manufactured to be identical to one another, thereby decreasing the manufacturing expense. As best shown in FIGS. 4 and 7, first jaw member 14 and second jaw member 16 respectively comprise mutually facing, interiorally directed first arcuate gripping member 18 and second arcuate gripping member 20. The first jaw member 14 and the second jaw member 16 are pivotally connected together with central fastener 22. First jaw member 14 and second jaw member 16 each have pivoting aperture 24, which apertures are aligned in overlapping manner. A bushing 26 or bearing may be used for insertion of central fastener 22. Central fastener 22 may be retained on the backside of the device with washer 28 and nut 30. In addition, a lock lever 32 may be mounted on the central fastener 22 which may be used to retain the device in an open position as described further below.

Figure 5:
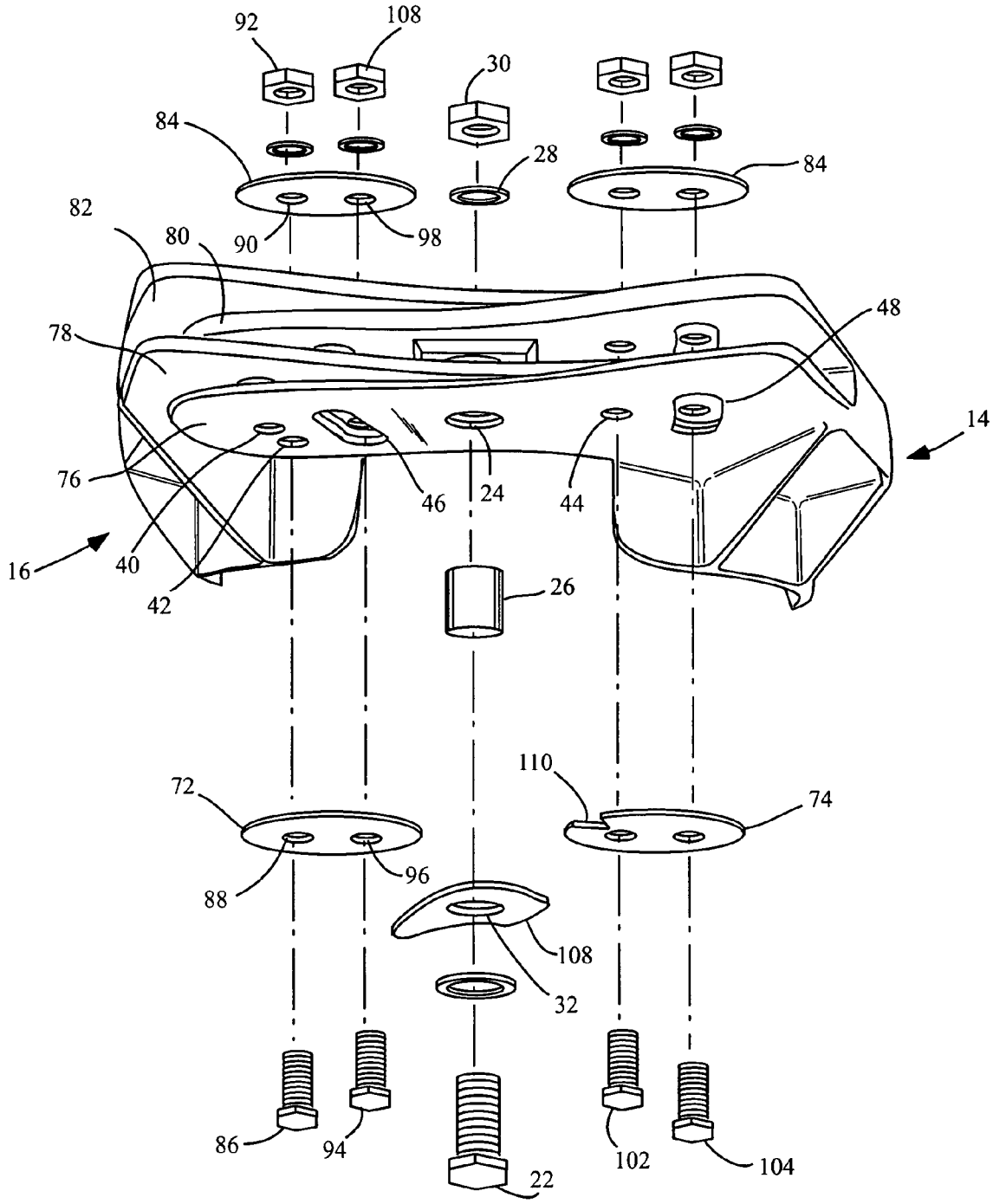
FIG. 5 shows the positioning of the jaw members with respect to one another, where the lifting linkage is not shown.
Figure 6:
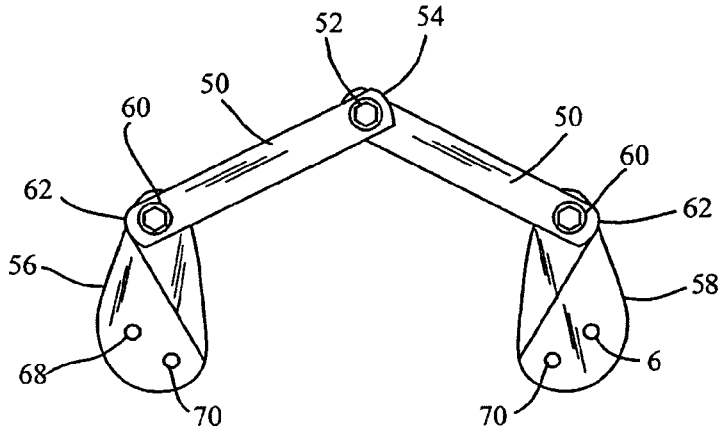
FIG. 6 shows an embodiment of lifting linkage which may be used in an embodiment of the disclosed lifting tongs.

As shown in FIGS. 4 and 5, above their respective gripping members 18, 20, first jaw member 14 and second jaw member 16 respectively comprise mounting members rigidly joined to each gripping member, such as first parallel plate member 34 and second parallel plate member 36. As shown, the first and second parallel plate members 34, 36 define a space there between. As best shown in FIG. 5, when the first jaw member 14 and the second jaw member 16 are pivotally connected together, the parallel plate members 34, 36 may be sandwiched together. For sake of clarity, FIG. 5 does not show the lifting linkage assembly 38. As shown in FIG. 5, first parallel plate member 34 and second parallel plate member 36 are sandwiched together such that a plurality of apertures in the parallel plate members are aligned.

In addition to pivoting aperture 24, the parallel plate members 34, 36 each comprise at least three fixed apertures, hereinafter referred to as first adjusting aperture 40, second adjusting aperture 42, and inside aperture 44. The parallel plate members 34, 36 may further comprise outside slotted aperture 46 and inside slotted aperture 48.

When the parallel plate members 34, 36 are sandwiched together, fixed apertures of the first jaw member 14 are aligned with slotted apertures of the second jaw member 16 and vice-versa. That is, either first adjusting aperture 40 or second adjusting aperture 42 will align with inside slotted aperture 48, and inside aperture 44 will align with outside slotted aperture 46. To achieve a larger opening diameter, first adjusting aperture 40 is utilized. If the smaller diameter setting is desired, second adjusting aperture 42 is utilized. The range of pivoting of first jaw member 14 with second jaw member 16 is controlled by the respective lengths of outside slotted aperture 46 and inside slotted aperture 48.

The lifting tongs 10 further comprise a lifting linkage assembly 38. The lifting linkage assembly 38 comprises linking arms 50 which are connected with fastener 52 at the apex formed by the respective first ends 54 of each linking arm. A first lobe 56 and a second lobe 58 are each pivotally attached with fastener 60 at the second end 62 of each linking arm 50. It is to be appreciated that in addition to the bolts and nuts shown in FIG. 4, fastener 52 and fasteners 60 may comprise rivets or other acceptable fastening mechanisms. As shown in the exploded view of FIG. 4, the linking arms 50 may comprise a pair of matching link members 64. First lobe 56 and second lobe 58 each comprise three apertures. Attachment aperture 66 is used in combination with fastener 60 to attach each lobe to its respective linking arm 50. First lobe 56 and second lobe 58 each further comprise an outside aperture 68 and an inside aperture 70. As indicated on FIG. 4, first lobe 56 and second lobe 58 may be disposed within the space defined by parallel plate members 34, 36 when the parallel plate members are sandwiched together. Lobe 56 and lobe 58 are positioned such that outside aperture 68 and inside aperture 70 are aligned with apertures of the parallel plates as described below.

When lobes 56, 58 are positioned within the spaced defined by parallel plate members 34, 36, a general sequence of the components is shown in FIG. 5 (absent the lifting linkage assembly 38). The general sequence of the components is the optional front outside retainer plates 72, 74, first plate member 76 of the first jaw member 14, first plate member 78 of the second jaw member 16, lobe 56, second plate member 80 of the first jaw member, second plate member 82 of the second jaw member, and the optional back outside retainer plates 84.

To set the lifting tongs 10 for lifting larger diameter pipe, the components of the device may be configured as follows. First fastening member 86 is inserted through: (1) the outside aperture 88 of first front outside retainer plate 72; (2) first adjusting aperture 40 of first plate member 76 of the first jaw member 14; (3) inside slotted aperture 48 of first plate member 78 of the second jaw member 16; (4) outside aperture 68 of first lobe 56; (5) first adjusting aperture 40 of second plate member 80 of the first jaw member 14; (6) inside slotted aperture 48 of second plate member 82 of second jaw member 16; and (7) and the outside aperture 90 of first back outside retainer plate 84. First fastening member 86 is retained by nut 92 which may be used in combination with a washer. It is to be appreciated that first front outside retainer plate 72 and first back outside retainer plate are optional components and the device may be made and utilized without these components.

Second fastening member 94 is inserted through: (1) the inside aperture 96 of the optional first front outside retainer plate 72: (2) outside slotted aperture 46 of first plate member 76 of the first jaw member 14; (3) inside aperture 44 of the first plate member 78 of the second jaw member 16; (4) inside aperture 70 of lobe 56; (5) outside slotted aperture 46 of the second plate member 80 of the first jaw member 14; (6) inside aperture 44 of the second plate member 82 of the second jaw member 16; and (7) the inside aperture 94 of the optional first back outside retainer plate 84. Second fastening member 94 is retained by nut 100.

Third fastening member 102 and fourth fastening member 104 are similarly attached on the other side of the device, with fourth fastening member 104 being inserted through first adjusting aperture 40 of first plate member 78 of the second jaw member 16.

To set the lifting tongs 10 for lifting smaller diameter pipe, the only change to the above configuration is that first fastening member 86 is inserted through second adjusting aperture 42 of first jaw member 14 instead of first adjusting aperture 40, and fourth fastening member 104 is inserted through second adjusting aperture 42 of second jaw member 16 instead of first adjusting aperture 40. Thus, changing the size range of the lifting tongs may be accomplished by simply changing the position of two bolts. It is to be appreciated that while fastening members 86, 94, 102, and 104 are generally shown in the figures as bolt and nut combinations, a pin/cotter pin arrangement might be used as well.

The lifting linkage assembly 38 works cooperatively with the opposing jaw members 14, 16 such that as a lifting force is applied to the apex of the lifting linkage, thereby lifting lobes 56, 58, thereby causing each jaw member to pivot about central fastener 22, causing the jaws to close about the pipe 12. The range of closure is controlled by the limited travel of fasteners 86, 94, 102 and 104 within slotted apertures 46, 48.

The lifting tongs 10 engage a length of pipe 12 by being lowered by means of a crane hook onto the section of pipe. The lifting linkage assembly 38 is adapted to receive the crane hook by having hook connection means, such as an attached clevis 106. As shown in FIGS. 1 and 2, a lock lever 32 may be mounted on the central fastener 22. Lock lever 32 is configured such that an engagement section 108 of the lever may engage the corresponding cut-out portion 110 of second front outside retainer plate 74. In comparing FIG. 1 with FIG. 2, it is seen that the front outside retainer plates 72, 74 change positions with respect to the jaw members 14, 16 as the lifting tongs are either opened or closed. Lock lever 32 may be used to lock outside retainer plate 74 in a fixed position, thereby preventing jaw members 14, 16 to change position.

When the lifting tongs 10 are lowered onto the pipe 12, lock lever 32 may be positioned such that engagement section 108 engages cut-out portion 110, thereby keeping the jaws fully opened for placing the lifting tongs onto the pipe 12.

When the lifting tongs 10 are placed in the fully opened position, the linking arms 50 approach a horizontal orientation as shown in FIG. 1, causing the lobes 56, 58 and the connected jaw members 14, 16 to move outwardly, such that the jaws are fully opened.

When the pipe 12 is to be raised, the lock lever 32 is disengaged. As the crane hook lifts vertically upwardly on the hook connection means, the linking arms 50 are caused to scissor together as shown in FIG. 2. As the linking arms scissor, the attached lobes 56, 58 are pivoted inwardly, simultaneously causing the connected jaw members 14, 16 to pivot inwardly, securing the pipe 12 within the lifting tongs 10.

The disclosed lifting tongs may be manufactured from a variety of materials. In order to reduce the weight of the tongs and to make the device more manageable for manual positioning, the device may be manufactured from cast aluminum. Alternatively, the device may be manufactured from machined steel or metal alloy components.

While the above is a description of various embodiments of the present invention, further modifications may be employed without departing from the spirit and scope of the present invention. Thus the scope of the invention should not be limited by the specific structures disclosed. Instead the true scope of the invention should be determined by the following claims.

What is claimed is:

1. Lifting tongs for grasping lengths of a pipe, the lifting tongs having an open position for receiving the pipe and a closed position for closing around the pipe, the lifting tongs comprising:

a first jaw member comprising a first arcuate gripping member and a first mounting member rigidly joined to the first arcuate gripping member wherein the first mounting member comprises a first parallel plate member and the first parallel plate member comprises a plurality of circular apertures and slotted apertures;

a second jaw member comprising a second arcuate gripping member and a second mounting member rigidly joined to the second arcuate gripping member, wherein the second mounting member comprises a second parallel plate member and the second parallel plate member comprises a plurality of circular apertures and slotted apertures, the first jaw member pivotally connected to the second jaw member such that the first arcuate gripping member and the second arcuate gripping member are disposed in spaced apart facing relation wherein the parallel plate members of the first jaw member and the parallel plate members of the second jaw member are sandwiched together; and selectively configurable pipe diameter adjustment means comprising a first pipe diameter setting or, in the alternative, a second pipe diameter setting, wherein the first pipe diameter setting and the second pipe diameter settings are defined by the positions of the first arcuate gripping member and the second arcuate gripping member with respect to one another, the first pipe diameter setting having a first dimension when the lifting tongs are in the open position and a second dimension when the lifting tongs are in the closed position, and the second pipe diameter setting having a third dimension when the lifting tongs are in the open position and a fourth dimension when the lifting tongs are in the closed position.

2. The lifting tongs of claim 1 wherein the first mounting member and the second mounting member each comprise a plurality of apertures.

3. The lifting tongs of claim 1 wherein at least one circular aperture in the first jaw member is aligned with a slotted aperture in the second jaw member.

4. The lifting tongs of claim 3 wherein a fastener is disposed through the circular aperture in the first jaw member, the fastener extending through the slotted aperture in the second jaw member.

5. The lifting tongs of claim 4 wherein the range of pivoting of the first jaw member with respect to the second jaw member is limited by the length of the slotted aperture.

6. The lifting tongs of claim 5 wherein a range of motion is defined by the dimensional difference between the open position and the closed position.

7. The lifting tongs of claim 6 wherein the range of motion is controlled by the length of the slotted aperature.

8. The lifting tongs of claim 1 further comprising a lifting linkage assembly attached to the first jaw member and the second jaw member.

9. The lifting tongs of claim 8 wherein the lifting linkage assembly comprises a first linking arm and a second linking arm, the first linking arm and the second linking arm each comprising a first end and a second end, wherein the first ends of each linking arm are connected together.

10. The lifting tongs of claim 9 wherein the lifting linkage assembly comprises a first lobe pivotally attached to the second end of the first linking arm and a second lobe pivotally attached to the second end of the second linking arm.

11. Lifting tongs for grasping lengths of a pipe, the lifting tongs comprising selective pipe diameter adjustment means comprising a first pipe diameter setting or, in the alternative, a second pipe diameter setting, wherein the lifting tongs comprise:

a first jaw member comprising a first arcuate gripping member and a first mounting member rigidly joined to the first arcuate gripping member;

a second jaw member comprising a second arcuate gripping member and a second mounting member rigidly joined to the second arcuate gripping member, the first jaw member pivotally connected to the second jaw member such that the first arcuate gripping member and the second arcuate gripping member are disposed in spaced apart facing relation;

the first mounting member comprising a first circular aperture for selecting the first pipe diameter setting and a second circular aperture for selecting the second pipe diameter setting; and the second mounting member comprising a first slotted aperture selectively alignable with either the first circular aperture for selecting the first pipe diameter setting or the second circular aperture for selecting the second pipe diameter setting.

12. The lifting tongs of claim 11 wherein the first jaw member and the second jaw member are identical.

* * * * *